United States Patent [19]

Ilievsky et al.

[11] Patent Number: 5,036,783

[45] Date of Patent: Aug. 6, 1991

[54] SAILING YACHT WITH A CENTERBOARD

[76] Inventors: Valery I. Ilievsky, ulitsa Nezhinskaya, 13, kv. 119; Vladimir J. Emelyanov, Khokhlovsky pereulok, 11, kv. 13; Boris A. Medvedev, 1 Khoroshevsky proezd, 4, korpus 1, kv. 30; Evgeny Y. Pivkin, ulitsa Kastanaevskaya, 37, kv. 26, all of Moscow, U.S.S.R.

[21] Appl. No.: 423,419

[22] PCT Filed: Jan. 21, 1988

[86] PCT No.: PCT/SU88/00016

§ 371 Date: Sep. 20, 1989

§ 102(e) Date: Sep. 20, 1989

[87] PCT Pub. No.: WO89/06621

PCT Pub. Date: Jul. 27, 1989

[51] Int. Cl.[5] ..... B63B 41/00

[52] U.S. Cl. ..... 114/138; 114/141

[58] Field of Search ..... 114/127, 130–141

[56] References Cited

U.S. PATENT DOCUMENTS

| | | | |
|---|---|---|---|
| 277,406 | 5/1983 | Bell | 114/138 |
| 465,114 | 12/1891 | Paul | 114/141 |
| 667,158 | 1/1901 | Webster | 114/138 |
| 685,648 | 10/1901 | Schoenhut | 114/138 |
| 2,466,006 | 4/1949 | Danko | 114/138 |
| 3,291,088 | 12/1966 | Klose | 114/138 |
| 3,547,065 | 12/1970 | Chaveau | 114/138 |
| 4,690,089 | 9/1987 | Marggraff | 114/138 |
| 4,759,552 | 7/1988 | Schutz | 114/138 |

FOREIGN PATENT DOCUMENTS 7128870 8/1971 France .

*Primary Examiner*—Joseph F. Peters, Jr.
*Assistant Examiner*—Clifford T. Bartz
*Attorney, Agent, or Firm*—Lilling & Lilling

[57] ABSTRACT

In a sailing yacht with a centerboard having a hull accommodating a centerboard well containing the centerboard capable of movement therein through rollers along curvilinear guides provided in the centerboard well, according to the invention, the rollers and guides are positioned at either side of the centerboard along its stern edge, the rollers being secured immediately on the centerboard.

4 Claims, 3 Drawing Sheets

SAILING YACHT WITH A CENTERBOARD

BACKGROUND OF THE INVENTION

1. Description of the Related Art

The invention relates generally to shipbuilding, and more particularly to sailing yachts having a centerboard.

2. Background of the Invention

There are known sailing yachts provided with a straight drop-keel or centerboard.

Accommodated in the middle portion of the yacht hull is a rectangular centerboard well receiving a substantially rectangular centerboard capable of movement in the vertical plane. Sliding of the centerboard from the well is prevented by lock pins.

Substantial manual efforts are required for dropping or retracting the centerboard whereas a system of tackles is required in the "Micro" or larger class yachts. The sailing yachts having a drop-keel centerboard are usually so constructed that in the raised position the centerboard occupies much space either in the cockpit or in the cabin. This in turn makes such yachts less comfortable, another disadvantage of such yachts being a rather low sailing performance, due to that the drop-keel centerboards do not allow the yachts to head in the wind accompanied by an increase in the hydraulic resistance and reduction in the speed of the yacht.

There is also known a centerboard sailing yacht as described in U.S. Pat. No. 3,547,065. The straight centerboard is fashioned as a parallelogram with a system for raising and lowering the centerboard including guides inside the centerboard well with rollers on which the centerboard moves.

Modification of the system for raising and lowering the centerboard substantially facilitates handling of the yacht, although fails to make the yacht more comfortable. However, a principle disadvantage of such a yacht is low sailing performance accounted by the shape of the centerboard making it impossible to control the center of sail, and the arrangement of the centerboard relative to the hull. Such structural disadvantages result in an increase in the hydraulic resistance, and consequently in a loss of speed as the yacht heads in the wind.

Attempts to partially obviate the heretofore mentioned disadvantages are known from the same patent U.S. Pat. No. 3,547,065. The sailing yacht described herein comprises a hull the bow part of which accommodates a centerboard well. Provided inside the well are curvilinear guides, and the centerboard moves on rollers. This centerboard easily moves along the guides, whereas its shape and arrangement make the yacht more comfortable by placing the centerboard out of the cabin or cockpit. In addition, the curvilinear shape of the centerboard makes it possible to control the center of lateral resistance of the yacht by changing the position of the geometrical center.

However, while solving partially the known problems, the prototype features such disadvantages as low sailing performance of the yacht. This centerboard construction makes it possible to prevent deviation of the centerboard in the longitudinal centerplane of the yacht which leads, as the yacht heads in the wind, to an increase in the hydraulic resistance and loss of speed. In order to control the center of lateral resistance, the curvilinear guides are such that the height of the centerboard well is greater, affecting the space of the cabin, which makes the cabin less comfortable for the crew.

Notwithstanding the fact that such a centerboard construction affords to control the center of lateral resistance, the range of such control is negligeable. Therewith, a change in the lateral resistance of the yacht attainable through retracting the centerboard in the well results in reduced useful surface and consequently in diminishing the principle function thereof, viz., provision of the lateral resistance. It is also to be noted that this construction of the centerboard overcomplicates assembly and repair operations, since the centerboard can be inserted to or removed from the well only through the well outlet at the bottom of the yacht.

SUMMARY OF THE INVENTION

The present invention is directed toward the provision of a sailing yacht having such a construction of the centerboard as to improve the sailing performance through reducing the hydraulic resistance of the yacht as it moves in the wind and controlling the center of lateral resistance within a wide range, while maintaining the useful centerboard area, making the cabin or cockpit more comfortable for the crew, and simplifying assembly and repair operations.

The aims of providing a sailing yacht with a centerboard capable of improving its sailing performance is attained by a sailing yacht the hull of which accommodates a well with a centerboard capable of movement therein on rollers along curvilinear guides provided in the well. According to the invention, the rollers and guides are positioned at both sides of the centerboard along its stern edge, the roller being secured directly on the centerboard.

Such and arrangement allows the centerboard to deviate from the longitudinal centerplane during sharp courses, thereby reducing the hydraulic resistance and allowing a higher speed. Improvement in the sailing performance is attained due to that the angle of attack is increased in response to deviation of the centerboard in plan in a preset direction to an angle to 2–3°.

Such a deviation takes place automatically under the action of the incident flow of water, as the yacht heads windwards with an inevitable drift. After tacking the incoming flow of water causes the centerboard to swing to the opposite side by turning relative to the line connecting the rollers mounted at the stern edge.

The centerboard can be constructed so that the shape of its bow edge corresponds to the shape of the keel line of the hull under the centerboard well, whereas the stern edge and longitudinal axis of the guides have the shape of arcs of concentric circles.

This construction enables considerable reduction in the height of the centerboard well through a more complete utilization of its interior to result in more headroom in the cabin thereby making the yacht more comfortable.

Preferably, the stern edge of the centerboard has the shape of an arc of a circle having a radius:

$$R_d = \frac{0.33\ L_{wL}}{2 \sin(\text{arc tg } 0.33)}, \text{ where}$$

$R_d$ is the radius of curvature of the stern edge of the centerboard; and $L_{wL}$ is the length of the hull along the waterline.

Such an arrangement attains the optimum relationship between the dimensions of the centerboard, centerboard well, and cabin.

Alternatively, the longitudinal axis of each guide has the shape of two interconnected arcs of circles with centers thereof resting at one side of the longitudinal axis, the radius of the arc nearest the outlet from the centerboard well being smaller than the radius of the other arc.

This arrangement of the guides allows the centerboard to vary the lateral resistance within a wide range. Displacement of the center of lateral resistance of the centerboard bowise relative to the center of sail pressure results in a larger surface area of the centerboard, and consequently in reduce yacht drift.

Preferably, the curvilinear guides are U-shaped, the upper shelf of the guides having recesses to ensure the passage of the rollers therethrough.

This shape of the guides ensures more convenient assembly operations. The centerboard can be therefore installed through the cabin without resorting to keel-blocking.

BRIEF DESCRIPTION OF THE DRAWINGS

These and other advantages of the present invention will become more fully apparent from a more detailed description that follows with reference to the accompanying drawings, in which.

DESCRIPTION OF THE PREFERRED EMBODIMENTS

Figure 2:
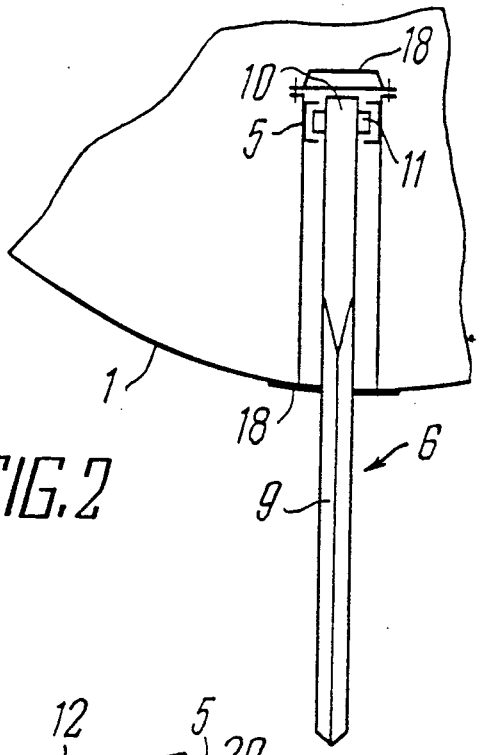
FIG. 2 is an enlarged cross section of a centerboard well.
Figure 4:
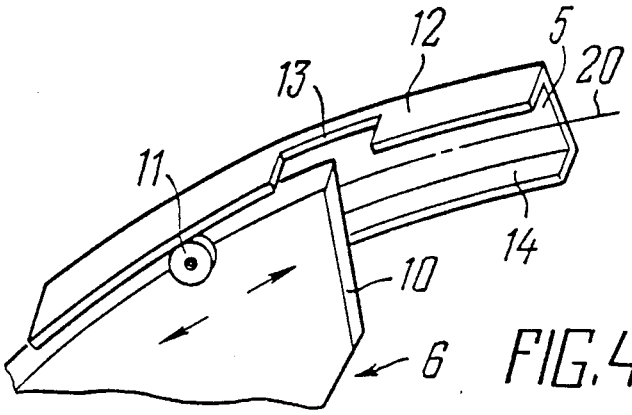
FIG. 4 is a centerboard well in which curvilinear guides are curved in the form of two interconnected arcs of a circle of different radii.
Figure 3:
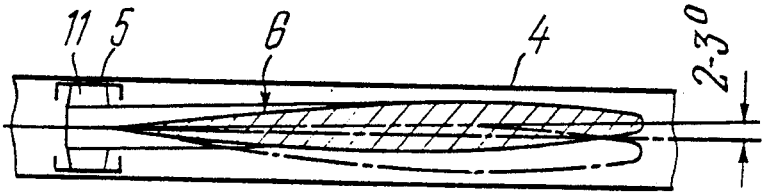
FIG. 3 is an alternative modification of a curvilinear guide with a recess in the upper shelf thereof.
Figure 5:
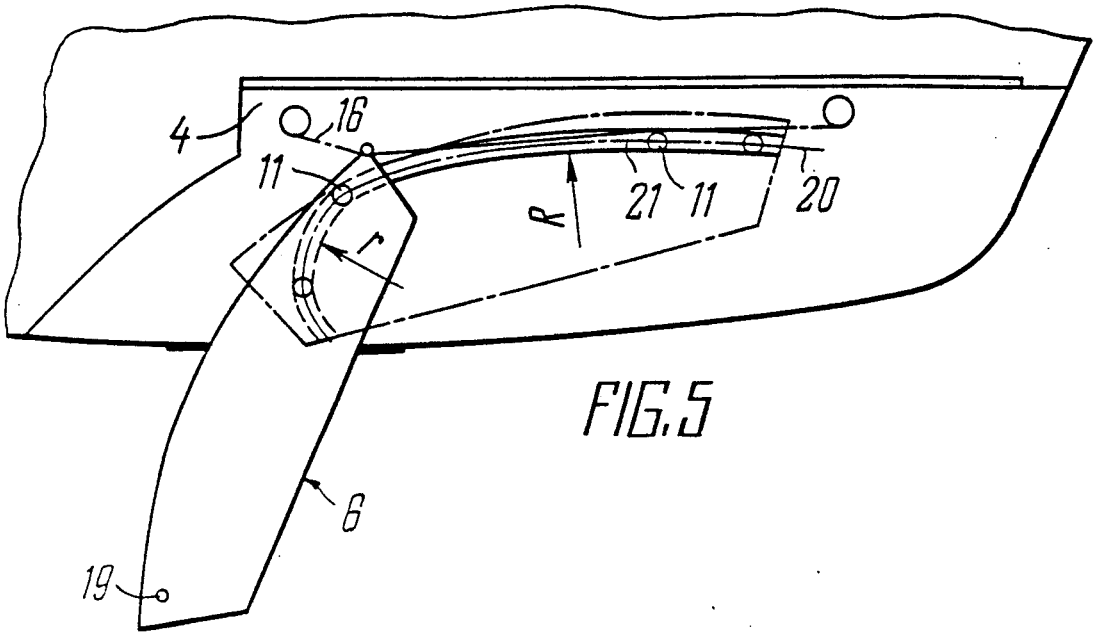
FIG. 5 is a plan view of the centerboard.

The proposed centerboard sailing yacht comprises a hull I (FIG. 1), a deck 2, and rigging 3. Arranged inside the hull I is a centerboard well 4 having curvilinear guides 5 at both sides of the centerboard 6, which includes a stern edge 7 and a bow edge 8. The guides 5 extend along the stern edge 7 of the centerboard consisting of two parts (FIGS. 1 and 2): a tear-shaped submerged part 9, and non-streamlined part 10 always resting inside the well 4 and rollers 11 arranged in paris at the sides of the stern edge. The most preferable arrangement of the rollers is at the top of the nonstreamlined part thereof. The number of rollers to be employed depends on the size of the centerboard, and is determined from the present angle of inclination relative to the longitudinal centerplane. Arrangement of the rollers at the top of the centerboard is preferable because it allows suspension of the centerboard on the guides 5 for the centerboard to be capable of deviating, relative to the longitudinal centerplane, by a certain angle (FIG. 3), such as 2–3° (optimum for the "Micro" class yachts). The guides 5 of the centerboard are U-shaped, and an upper shelf 12 thereof has recesses 13 (FIG. 4) to allow the passage of rollers 11 therethrough. The upper shelves 12 of the guides 5 are arranged at one level and have equal curviture. Lower shelves 14 ensure suspension of the centerboard in the well and movement thereof along the guides. The yacht comprises a means 15 for lifting and lowering the centerboard 6 having the form of two ropes 16 (FIG. 5). The centerboard well 4 has a cover 17 at the top, and an elastic spacer 18 at the bottom. The centerboard has a ballasting hole 19 through which the interior of the centerboard is filled with water. The stern edge of the centerboard is shaped as an arc of a circle having a radius determined from:

$$R_d = \frac{0.33\ L_{wL}}{2\ \text{Sin (arc tg } 0.33)}\text{, where}$$

$R_d$ is the radius of curvature of the stern edge of the centerboard; and $L_{wL}$ is the length of the hull along the waterline.

The shape of curvature of the guides is dictated by the size of the yacht and its designation (e.g., a racing yacht, or a pleasure yacht). Particularly, in the proposed embodiment a longitudinal axis 20 (FIG. 5) of the guides 21 can have the shape of two interconnected arcs of circles "R" and "r" with centers thereof resting at one side of the longitudinal axis, the radius "r" of the arc closest to the outlet from the centerboard well 4 being smaller than the radius "R" of the other arc.

The sailing yacht having a centerboard according to the invention is operated as follows.

Figure 1:
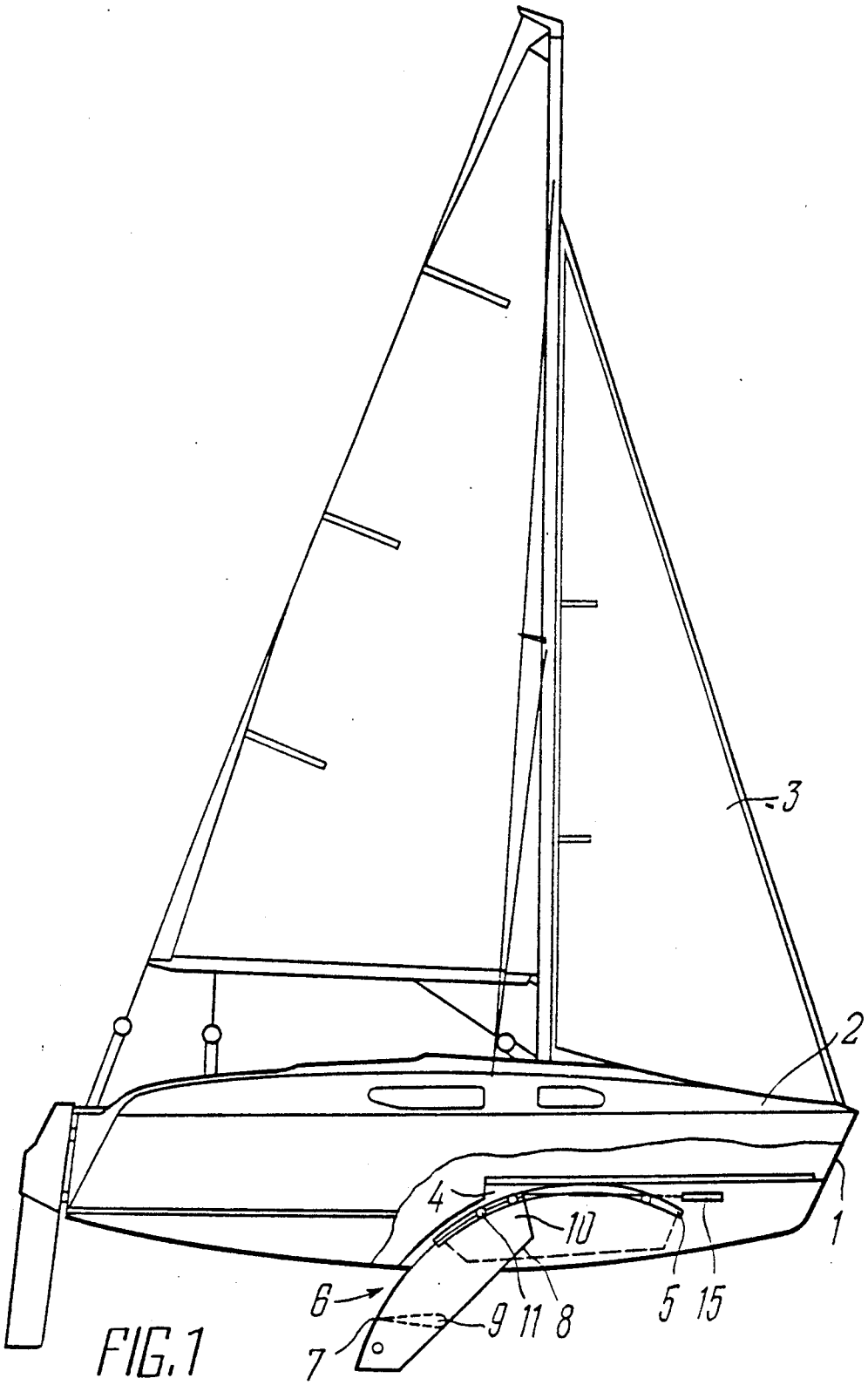
FIG. 1 is a side partially cut-away view of the proposed yacht having a centerboard.

In a fair wind, when the centerboard is completely retracted in the well 4, its center of gravity is below the geometrical center, which ensures stable position thereof inside the well (FIG. 1). Such a position of the centerboard prevents inadvertent dropping thereof form the well, and does not require a special system for locking the centerboard in the extreme working and non-working positions.

When the wind changes, and the drift force is great relative to the force which moves the yacht forward, it is necessary to provide a substantial lateral resistance. With this aim in view and depending on the course of the yacht, the centerboard is lowered to a required depth. As the centerboard is lowered, the interior of the centerboard is filled with water through the hole 19. Raising and lowering the centerboard is executed by a system of ropes 16 handled from the cockpit (not shown).

Figure 6:
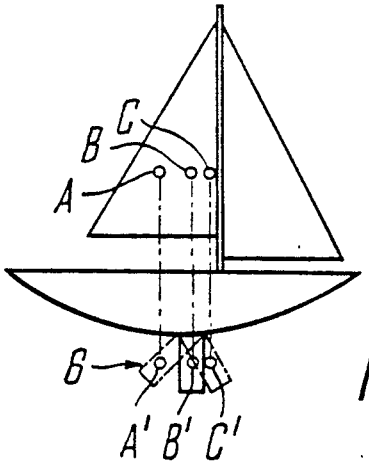
FIG. 6 is a schematic representation of the position of the center of sail pressure in response to variations in the position of the center of lateral resistance of the centerboard.

For carrying out preventive maintenance the cover 17 of the centerboard well 4 is swung back, the rollers 11 are registered with the recesses 13, and the centerboard is removed from the well. Mounting the centerboard inside the well during assembly is done in the following manner. The centerboard is lowered between the guides so that the rollers 11 could enter the recesses 13 and bear on the lower shelves 14 of the centerboard guides. The thus facilitated assembly has been made possible thanks to structural modifications of the yacht, which simplifies preventive maintenance and repair operations. For the yacht to retain a given straight movement it is necessary to continuously align the center of lateral resistance with the center of sail pressure (FIG. 6). Assuming that the yacht heads on a set course, the center of sail pressure and the center of lateral resistance of the centerboard rest along one line at points B and B', respectively. (FIG. 6). If the center of sail pressure moves to point C and the centerboard remains in the same position, a swinging moment occurs. In this case for the yacht to retain the present course it is necessary to align the center of lateral resistance of the centerboard with the center of sail pressure such that they again lie in one line. For this purpose the centerboard is lowered from the well so that the center of lateral resistance thereof would be at point C'. This is accompanied by an increase in the useful surface area of the centerboard. Conversely, when the center of sail pressure moves to point A, the centerboard should be retracted in the well so that its center of lateral resistance could displace to point A'.

The proposed centerboard arrangement can be used for yachts of any dimensions. The invention allows to improve the sailing performance of the yacht through reducing the hydraulic resistance of the yacht as it moves in the wind, and expand the range of adjustment to improve the steerability of the yacht. Another advantage is improved performance and more comfortable conditions on board, since the proposed technical solution allows retraction the centerboard to a well of a substantially reduced height, the position of the well inside the hull allowing a maximum use of the interior volume of the yacht, as well as facilitating assembly and repair operations by making it possible to install the centerboard from the inside of the cabin, rather than from the yacht bottom, thus obviating the need for keel-blocking the yacht.

We claim:

1. A sailing yacht with a centerboard comprising a hull accommodating a centerboard well containing the centerboard capable of movement therein through rollers along curvilinear shaped guides, wherein the rollers and horizontal shelves of the guides are positioned at both sides of the centerboard along its stern edge, the rollers being secured on lateral surfaces of the centerboard at the stern edge of its non-immersible portion to rest on horizontal shelves of the guides.

2. A sailing yacht as claimed in claim 1, wherein the shape of a bow edge of the centerboard corresponds to the shape of a keel line of the hull under the centerboard well, whereas the stern edge and longitudinal axis of the guides have the shape of arcs of concentric circles.

3. A sailing yacht as claimed in claim 2, wherein the stern edge of the centerboard has the shape of an arc of a circle having a radius:

$$R_d = \frac{0.33\ L_{wL}}{2 \sin(\text{arc tg } 0.33)}, \text{ where}$$

$R_d$ is the radius of curvature of the stern edge of the centerboard; and $L_{wL}$ is the length of the hull along the waterline.

4. A sailing yacht as claimed in claim 1, wherein the longitudinal axis of each guide has the shape of two interconnected arcs of circles with centers thereof resting at one side of the longitudinal axis, whereas the radius of the arc nearest to an outlet from the centerboard well is less than the radius of the other arc.

* * * * *